United States Patent [19]

Davies, deceased et al.

[11] 3,933,107

[45] Jan. 20, 1976

[54] SEWING MACHINES

[75] Inventors: Philip Henri Davies, deceased, late of Brightlingsea, England; by Bessie Snowden Davies, executrix

[73] Assignee: Allbook & Hashfield Holdings Limited, London, England

[22] Filed: Apr. 17, 1974

[21] Appl. No.: 461,507

[30] Foreign Application Priority Data

Apr. 19, 1973 United Kingdom ..... 19148/73

[52] U.S. Cl. ..... 112/256

[51] Int. Cl.[2] ..... D05B 71/00

[58] Field of Search ..... 112/256, 14, 235; 184/6.15

[56] References Cited

UNITED STATES PATENTS

| | | | |
|---|---|---|---|
| 1,063,253 | 6/1913 | Gammons | 112/14 |
| 1,906,087 | 4/1933 | Parkes | 112/256 X |
| 1,937,019 | 11/1933 | Hamill | 112/256 X |
| 2,430,370 | 11/1947 | Smith | 112/256 |
| 2,477,115 | 8/1948 | Christensen | 112/256 |

FOREIGN PATENTS OR APPLICATIONS

| | | | |
|---|---|---|---|
| 822,988 | 11/1959 | United Kingdom | 112/256 |

*Primary Examiner*—George H. Krizmanich

[57] ABSTRACT

A sewing machine is provided with a lubricating pump that is operated when work feed members of the machine are engaged or released whereby a quantity of lubricating fluid is delivered to the machine mechanism immediately before the mechanism begins to run. A reciprocatory pump is used and supplies the fluid to a manifold having multiple feed apertures over required lubrication locations for the fluid issuing from the apertures to fall onto said locations. The manifold is displaceable as a unit to give access to the mechanism below it.

8 Claims, 5 Drawing Figures

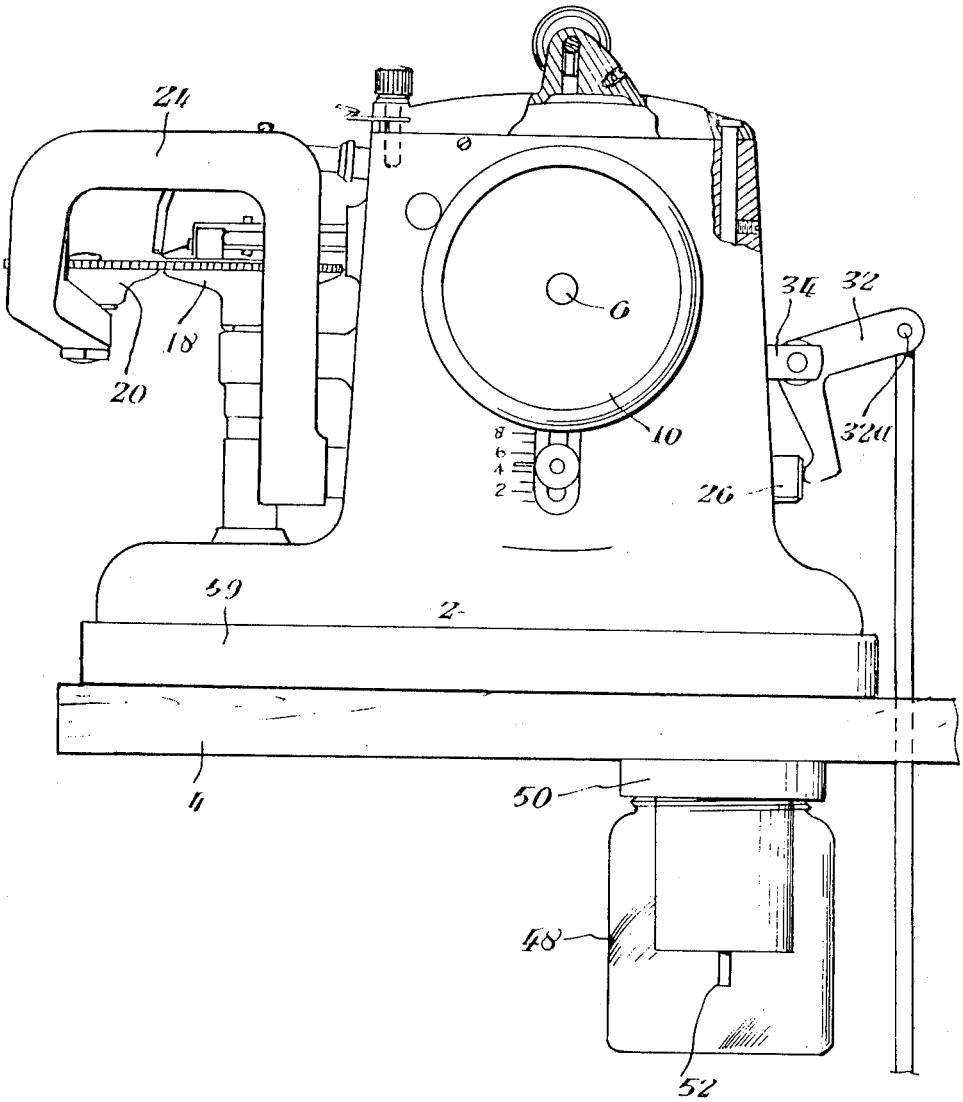
Fig. 2.
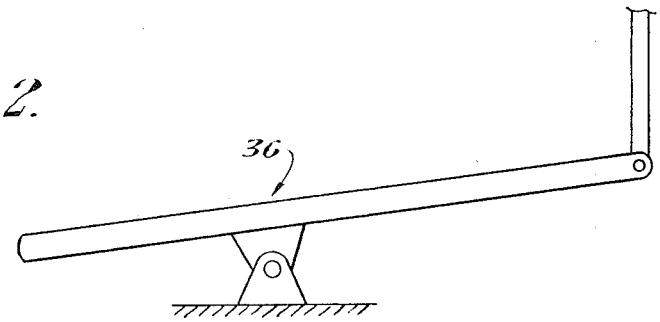

SEWING MACHINES

BACKGROUND OF THE INVENTION

This invention relates to sewing machines and is concerned particularly, but not exclusively, with sewing machines of the kind sometimes known as "cup overseaming machines" used to sew such materials as fur, skins and pelts (both natural and synthetic), felt, carpeting, plastics and knitwear.

The lubrication of the internal mechanisms of sewing machines can present problems. If it must be done manually by the operator, for example employing a drip feed from a pre-filled reservoir, the quantities of oil required at many locations may necessitate frequent fillings. Such an arrangement is very susceptible to human error, particularly as the operator may not have any special mechanical knowledge or skills and in industrial use it is frequently impossible without elaborate precautions to ensure that the lubrication is maintained.

This difficulty can of course be obviated by a forced feed of lubrication from a motor-driven pump, using mist lubrication techniques for example, but such a solution calls for complex and expensive mechanical adaptation and would be justified only in high-speed machines where there is a specific need for a high rate of circulation of lubricating fluid.

The present invention provides a means of lubrication that feeds the fluid intermittently but automatically, so that lubrication failure through operator error can be avoided, while at the same time said means are of a form that can be incorporated in a sewing machine in a more economical manner than a motor-driven forced feed lubrication system.

SUMMARY OF THE INVENTION

According to the invention, in a sewing machine comprising feed members for progressing the material to be sewn and means for relative displacement of said members between their operative position and an inoperative position for the insertion and/or removal of the material, there are now provided lubricating means for the machine mechanism, said means being arranged to be fed by a pump operable through the displacement means of the feed members.

To minimise the need for replenishing the lubricating fluid supply, advantageously such an arrangement is arranged to operate as a circulatory system, means being provided for drainage of lubricating fluid from the mechanism through filtering means to a sump supplying the pump.

Particularly suited to the object of the invention as a simple and positive means of lubricating fluid supply, is a pump comprising a reciprocable plunger movable in synchronism with said relative displacement of the feed members.

Preferably, the lubricating means include a delivery manifold connected to the pump outlet and comprising a plurality of branch conduits for the distribution of the lubricating fluid therefrom, and at least one of said branch conduits has a plurality of outlet openings at spaced positions along its length for the lubricating fluid.

The delivery manifold can be arranged above the sewing machine mechanism for the supply of the fluid to the mechanism by gravity, the manifold then preferably being mounted in a displaceable manner permitting its displacement to facilitate access to the mechanism from above. Thus, the delivery manifold may have a detachable connection to the pump outlet so that it can be removed from the machine when access to the underlying mechanism is required. Alternatively, said movement may be permitted by a pivot connection, such as a banjo pipe fitting.

BRIEF DESCRIPTION OF THE DRAWINGS

The accompanying drawings illustrate one embodiment of the invention by way of example. In the drawings, FIG. 2 is a view in the direction of arrow II of FIG. 1.

DESCRIPTION OF THE PREFERRED EMBODIMENT

Figure 1:
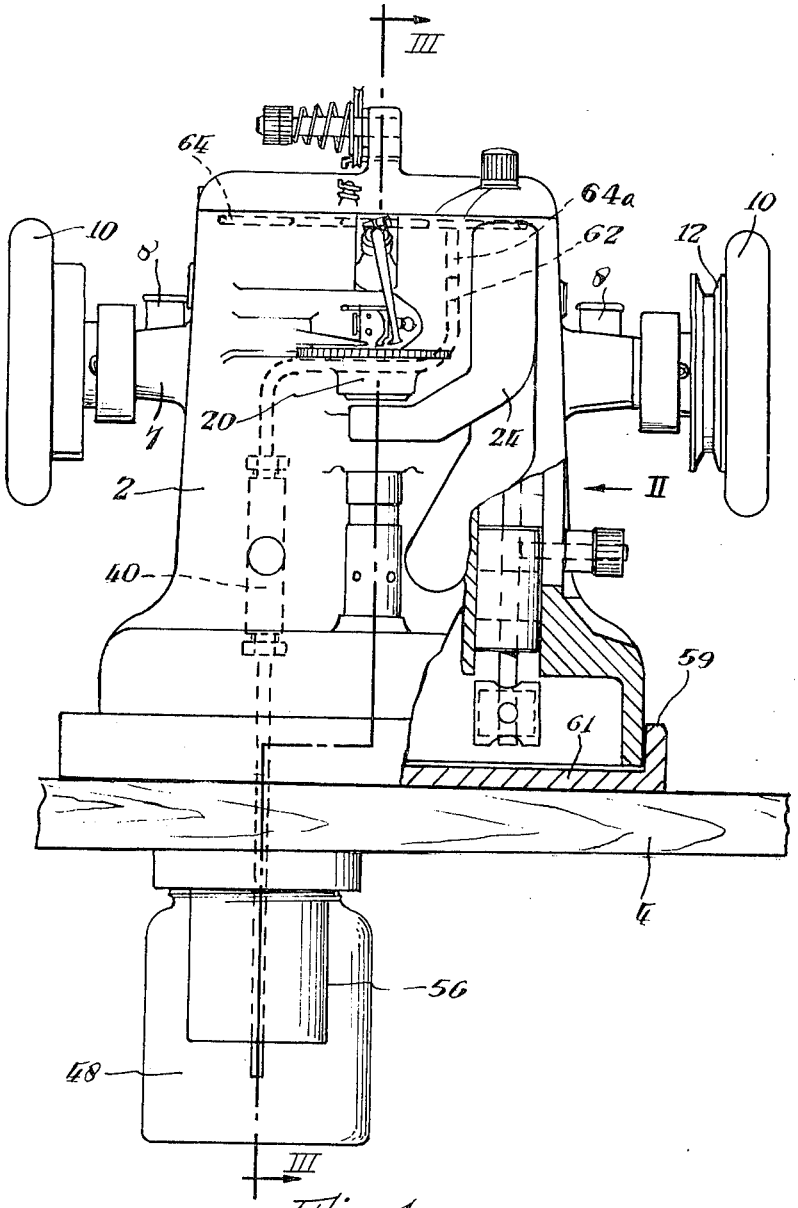
FIG. 1 is a partly-sectioned front elevation of the head of a fur sewing machine according to the invention.

The machine head illustrated comprises a cast casing 2 mounted on a workbench or table 4. A drive shaft 6 extends transversely across the casing through journals 7 in the casing side walls provided with respective lubricating wells 8, and carries respective fly-wheels 10 at its ends. A pulley 12 is formed integrally with one of the flywheels for a belt drive to the shaft 6 from a motor (not shown) mounted below the table.

Within the casing 2 and driven by the shaft 6 is a stitch-forming mechanism comprising a needle arm 14 and a looper 16 arranged to operate on a workpiece gripped between a pair of cups or feed wheels 18, 20. The stitch-forming mechanism is itself of a form that is well known in the art, and will not be further detailed as a description of it is unnecessary for an understanding of the present invention.

The first, rear cup or feed wheel 18 is mounted on a vertical shaft 22 that projects from the casing and that is driven from the shaft 6 in known manner for progressing material gripped between the wheels. The second, forward cup or feed wheel 20 is co-planar with the first wheel and is freely rotatable on a cranked arm 24 supported on the casing by a slide rod 26 extending rearwardly therethrough. A cross-member 28 projects transversely from the slide rod 26 intermediate the length of the rod, interconnecting it with a second parallel slide rod 26*a*, and a tension coil spring 30 is connected between the member 28 and the rear of the casing, drawing the slide rods rearwards and urging the second feed wheel 20 towards the first feed wheel 18 whereby the material to be overseamed is gripped between the wheels. By means of a pedal mechanism 36 below the table 4 connected to arm 32*a* of a bell crank lever 32 mounted on a lug 34 at the rear of the casing, the slide rod 26 can be urged forwardly to move the second feed wheel 20 away from the first feed wheel 18, against the action of the spring 30, for the insertion between them of the material to be overseamed.

A lubricating oil pump 40 comprising a reciprocating plunger or piston is fixed to the inside rear wall of the casing 2 and has a piston rod 42 extending parallel to the slide rod 26 and urged forwardly by a compression spring 46 to abut against the rear of the second slide rod 26*a*. The piston rod thus moves concurrently with the pair of slide rods 26, 26*a*.

The pump draws its supply of oil from a sump comprising a transparent container 48, permitting ready inspection of the oil level, releasably screwed into a plastics cap 50 secured by screws 51 to the underside of the table 4 so that the container is suspended therebelow and can easily be detached for refilling. Suction pipe 52 extends from the pump into the container and passes with a clearance through a vertical tubular inner wall 54 of an annular, permeable carrier 56, e.g. of metal gauze, for a filter body 58, the carrier being located by an upper flange 57 being clamped between the container and its cap. Forming a base for the casing 2 and closely fitting its bottom edge is an oil tray 59 that has its inner surface 61 sloping downwards to a drain tube 60 that surrounds the wall 54 of the carrier with a clearance and that extends into the filter, for drainage of oil into the filter body 58.

Figure 3:
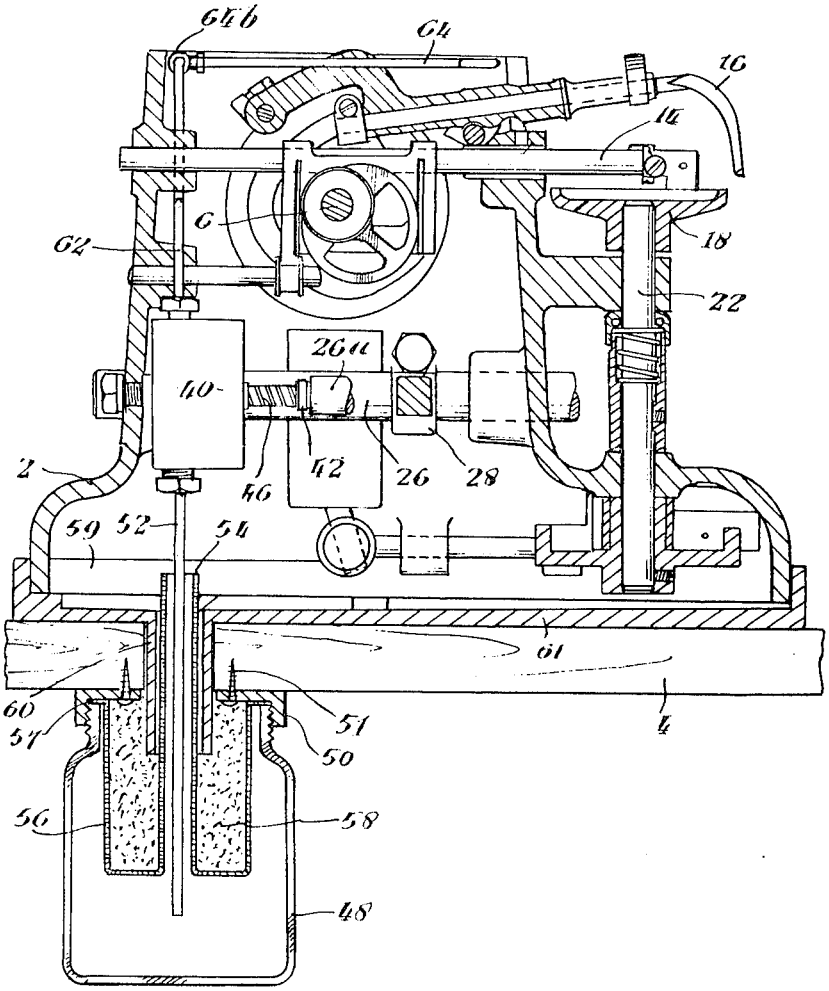
FIG. 3 is a section on line III—III of FIG. 1, with the cover of the machine head and the forward feed wheel arm omitted.
Figure 4:
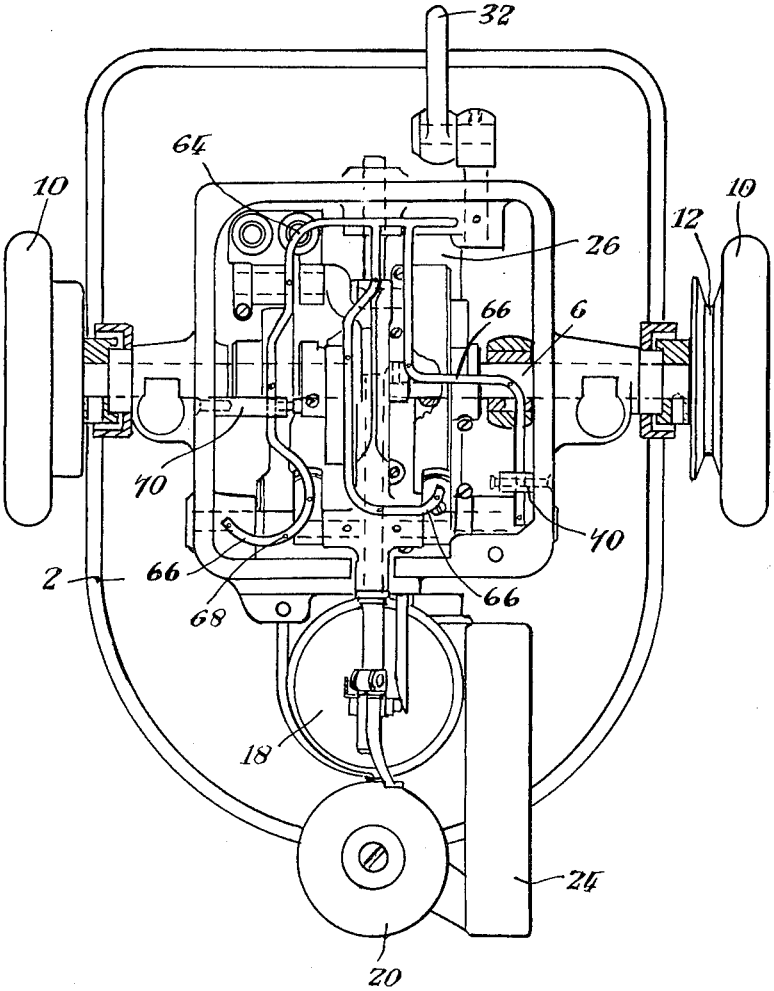
FIG. 4 is a top plan view of the machine head with the cover omitted.
Figure 5:
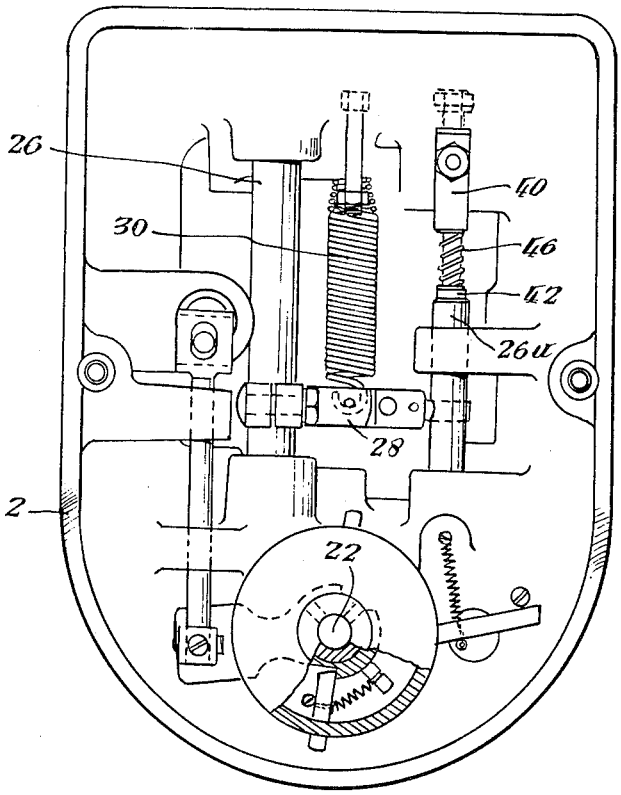
FIG. 5 is an underplan view of the machine head.

The pump delivers its output to a vertical riser 62 into the upper end of which is telescopically inserted (FIG. 1) a dependent entry portion 64*a* of an oil distribution manifold 64, FIG. 3 illustrates a modified form of connection of the manifold by way of a banjo coupling 64*b* in place of the telescopic fitting. The manifold comprises a series of branch conduits 66 each in communication with the entry portion and extending over the mechanism in the machine head. The conduits are sealed at their ends remote from the entry portion and apertures 68 are formed in the underside of their walls at points corresponding in plan to the position of elements of the mechanism to be lubricated. The manifold is supported by screw brackets 70 mounted on opposite sides of the casing.

In operation, each time the feed wheels are opened to insert or remove work, the pump piston rod 42 is correspondingly reciprocated and a small quantity of oil is delivered from the pump to the manifold 64 to escape through the manifold apertures onto the regions of the mechanism in the casing to be lubricated. This occurs without any special action or attention on the part of the operator and lubrication is thus ensured even though the rate of oil circulation need not be high. It will be noted, moreover, that the arrangement ensures that the machine mechanism will automatically receive lubrication immediately before it begins to run. Additional seals and gaskets may be required to ensure that the additional lubrication flow does not lead to any seepage of oil from the casing but for clarity these have not been indicated in the drawings.

When it is necessary to have access to the mechanism in the machine head casing for servicing, the oil distribution manifold can be released by releasing its brackets 70 and lifting upwards to detach it from its telescopic connection with the pump riser 62 (or pivoting it on the banjo coupling 64*b*) and it can be equally simply replaced.

I claim:

1. In a sewing machine comprising a sewing mechanism and feed members for progressing the material to be sewn and means for relative displacement of said members between their operative position and an inoperative position for the insertion and removal of the material, the improved lubrication means consisting essentially of a reservoir of lubricating fluid, a pump having inlet means communicating with said reservoir and outlet means separate and operatively independent from said inlet means leading to at least one lubrication location in the machine, an actuating member of the pump operatively connected with at least one of said feed members for displacement in synchronism with the relative displacement of the feed members whereby the supply of lubricating fluid to said at least one location is controlled by the relative movements of said members between their operative and inoperative positions.

2. A sewing machine according to claim 1 wherein said lubricating pump includes a suction pipe which extends into said reservoir for receiving the lubricating fluid, and a plunger reciprocating in said pump to cause a flow of said fluid through the pump, said plunger being arranged for reciprocation in synchronism with the relative displacement of the feed members.

3. A sewing machine according to claim 1 further comprising drainage means in communication with said reservoir for the return of lubricating fluid thereto, a filter device being disposed in the path of the fluid from the drainage means to the reservoir.

4. A sewing machine according to claim 1 wherein the reservoir comprises a transparent container, disengageable means securing the container to the machine permitting the container to be detached for replenishment of the lubricating fluid.

5. A sewing machine according to claim 1 wherein said pump outlet means comprises a delivery manifold comprising a plurality of branch conduits, a common feed conduit from the pump supplying said branch conduits for the distribution of fluid from the pump to a plurality of lubrication locations.

6. A sewing machine according to claim 5 wherein at least one of said branch conduits is provided with a plurality of fluid outlet openings at spaced positions along its length for the distribution of fluid from said branch conduit to a plurality of lubrication locations.

7. A sewing machine according to claim 5 wherein the delivery manifold is disposed in an operative position above the machine mechanism to supply the lubricating fluid thereto by gravity, means mounting the manifold in place to permit the manifold to be displaced from its operative position for facilitating access to said mechanism from above.

8. A sewing machine according to claim 5 wherein a displaceable connection is provided in said common feed conduit to permit the manifold to be displaced as a unit from an operative position for facilitating access to the machine mechanism.

* * * * *